US010977930B2

(12) United States Patent
Tieman

(10) Patent No.: US 10,977,930 B2
(45) Date of Patent: Apr. 13, 2021

(54) REMOTE CONTROL BUTTON ACTUATION SYSTEM WITH PROXY REMOTE

(71) Applicant: Blue Eclipse, LLC, Noblesville, IN (US)

(72) Inventor: Craig Arnold Tieman, Noblesville, IN (US)

(73) Assignee: Blue Eclipse, LLC, Noblesville, IN (US)

( * ) Notice: Subject to any disclaimer, the term of this patent is extended or adjusted under 35 U.S.C. 154(b) by 0 days.

(21) Appl. No.: 16/731,380

(22) Filed: Dec. 31, 2019

(65) Prior Publication Data

US 2020/0219383 A1 Jul. 9, 2020

Related U.S. Application Data

(60) Provisional application No. 62/788,225, filed on Jan. 4, 2019.

(51) Int. Cl.
*G08C 17/02* (2006.01)
*G07C 9/00* (2020.01)

(52) U.S. Cl.
CPC ..... *G08C 17/02* (2013.01); *G07C 9/00182* (2013.01); *G07C 9/00309* (2013.01); *G07C 9/00817* (2013.01); *G07C 2009/00214* (2013.01); *G07C 2009/00841* (2013.01); *G07C 2009/00984* (2013.01)

(58) Field of Classification Search
CPC ..... G08C 17/02; G08C 2009/00984; G08C 2201/93; G07C 9/00571; G07C 2009/00222; B60R 25/20; H01H 13/02
USPC ..... 340/12.5
See application file for complete search history.

(56) References Cited

U.S. PATENT DOCUMENTS

| | | | | |
|---|---|---|---|---|
| 2009/0108989 | A1 | 4/2009 | Sinclair | |
| 2016/0098870 | A1* | 4/2016 | Bergerhoff | G07C 9/20 340/5.61 |
| 2020/0055487 | A1* | 2/2020 | Tieman | G07C 9/29 |
| 2020/0148167 | A1* | 5/2020 | Gersabeck | B60R 25/23 |

* cited by examiner

*Primary Examiner* — Vernal U Brown
(74) *Attorney, Agent, or Firm* — Andrus Intellectual Property Law, LLP

(57) ABSTRACT

An actuation system used to actuate one or more buttons on a remote control device, such as a key fob, based upon commands that are generated from a mobile device. The actuation system includes a key fob enclosure located remotely from the vehicle. When a command is received on the mobile device, the command is relayed to a controller within the key fob enclosure, causing a button on the key fob to be depressed. The RF signal from the key fob is translated into a digital message which is relayed to a proxy remote located within the vehicle. The proxy remote, in turn, translates the digital message to an RF signal which is transmitted and received by systems within the vehicle. In this manner, the proxy remote is able to communicate using RF signals with the vehicle without requiring the key fob to be located near the vehicle.

20 Claims, 3 Drawing Sheets

REMOTE CONTROL BUTTON ACTUATION SYSTEM WITH PROXY REMOTE

CROSS REFERENCE TO RELATED APPLICATION

The present application is based on and claims priority to U.S. Provisional Patent Application Ser. No. 62/788,225, filed Jan. 4, 2019, the disclosure of which is incorporated herein by reference.

BACKGROUND

Electronic systems in automotive vehicles and other devices may utilize handheld remote controls with finger-pressable buttons. These devices can be utilized to remotely actuate vehicle or device functions by hand, where such functions may be difficult to access otherwise by a vehicle operator. The remote controls of these electronic systems generally permit secure remote actuation of unlocking, locking, power door and trunk opening, remote engine starting, activation of horns, lights and panic features as well as other types of vehicle or device functions when the remote is within a communication range of the vehicle and the remote.

In recent years, the rapid and widespread growth in long-range wireless connectivity and sophisticated handheld mobile devices with touch-type graphical user interfaces and short or long-range wireless connectivity has led to the proliferation of machine-to-machine connectivity solutions and "anywhere at any time" device interactivity. Consumers now expect all of their vehicles, homes and devices to be connected and able to be interacted with via their mobile technology from anywhere and at any time.

An increasing number of new vehicles come equipped with built-in wireless connectivity that enables connectivity to these vehicles via mobile devices and web-enabled devices for remote function actuation. Vehicles from General Motors, for example, equipped with ONSTAR telematics connectivity can be remotely started or unlocked with a smartphone running a downloaded software application ("app"). This is a proprietary, designed-in solution available only to purchasers of these vehicles and requires the purchase of an ongoing subscription from ONSTAR for the cellular data connectivity to the vehicle to enable this function.

It is generally known that vehicle electronics suppliers have been offering retrofitted systems to expand the remote control capabilities available to vehicle owners. Directed Electronics, for example, offers aftermarket systems that control more functions and provide longer-range of connectivity, including the addition of telematics communications for control from any location with a smartphone application. One primary limitation of these systems includes the need for extensive custom engineering efforts to enable the electronics to interface to and work with the electronics of the vehicles. In addition, consumers may be required to employ a professional technician for all installation efforts due to the technical complexity of the different vehicle installations. Consequently, these installations are generally expensive for consumers to consider.

More recently, suppliers of aftermarket vehicle electronics have introduced systems that consumers can self-install at low-cost and complexity. Delphi Automotive, for example, has recently introduced a system that can be plugged into a standardized on-board diagnostics (OBD-II) connector found on all light-duty vehicles since 1996. The vehicle owner can easily install the system and, after downloading a smartphone application, can have remote control of vehicle access functions from their smartphone or a web-enabled device. By leveraging features found standard in many vehicles, this system advantageously allows for the addition of a new radio-frequency (RF) transmitter to operate as a secure remote control using procedures built into the vehicle by its manufacturer. Other suppliers are attempting to reverse engineer data bus commands for each vehicle to permit long-range remote control of the functions of the vehicle by transmitting data bus commands onto the OBD-II connector from a consumer-installed device. The main limitations of the RF control technique are that many vehicles do not have any available method for adding a new transmitter by the owner. Additionally, many vehicles have such sophisticated secure RF designs that no method can be found practically to transmit the proper secure codes to a vehicle.

The main limitation of a data bus control technique is the extensive effort to reverse-engineer data bus commands for each vehicle. Additionally, many vehicles cannot be controlled via this connector at some or all of the time, such as when an owner is away from their vehicle due and/or due to a lack of available data bus commands.

U.S. Patent Publication No. 2009/0108989 A1 describes a remote control actuation system using a controller and solenoid(s) to press one or two remote control actuation buttons of a vehicle remote control. The system would be placed in a location within the confines of the vehicle. The '989 application describes an actuation method specific to a single type of remote control with a specific button location layout. The '989 application does not describe a configurable, or adaptable, system for mounting or actuating more than 2 buttons. The '989 application also fails to accommodate the numerous and widely-varying remote control multi-button designs found on vehicle remote control fobs, for example. Vehicle remote controls can have from 2 to 8 buttons in any type of layout and orientation on up to 3 surface planes of the remote control, varieties of package sizes and designs without a mechanical key blade and ones with fixed or movable mechanical key blades.

The '989 application also fails to provide for the linkage of remote control actuation to a user's mobile devices, e.g., a mobile smartphone application. Furthermore, the '989 application fails to describe a technique for blocking the vehicle detection of the remote control within the vehicle by low-frequency techniques used in vehicle immobilization or push-button engine start features. It is generally understood that vehicles and their remote controls can include a low-frequency circuitry that enables secure detection of the presence of the remote control within the vehicle. As such, blocking the RF function of the remote control and detection of the presence of the remote control can be used to prevent or alleviate the vehicle from being a target of drive-away theft.

Therefore, there is a need in the art for a remote control to control the functions of a vehicle and/or other device, specifically for a singular design for wireless connectivity enhancements of linkage to mobile devices which can be added to all existing vehicle or device remote control systems without special tools or training. A further need exists for a system that allows the remote or key fob for a vehicle or a remote actuator for another device to be retained at a remote location outside of the communication range of the vehicle or device for security of the device while allowing for operation of the vehicle or device utilizing a mobile device.

BRIEF SUMMARY

The presently disclosed embodiments, as well as features and aspects thereof, are directed towards a remote control button actuation system that can be positioned at a location remote from the vehicle (i.e. outside of the communication range of the vehicle) and operated to generate vehicle control commands. The remote control button actuation system includes a button actuator tip to actuate the buttons on a remote control for vehicle or device. In one embodiment of the disclosure, the button actuator tip can be moved to any position over the surface of the remote control. Once positioned over a remote control button, the button actuator tip may be lowered to press a remote control button. The servo motors may be controlled by a programmable controller that receives signals from either a mobile device via short or medium-range wireless signals or from a separate telematics gateway device which extends the range of control to the mobile device.

The various embodiments of the controller allow the command signals generated by the key fob to be converted from an RF signal to a digital message. The digital message is then communicated to a remote server platform, which then directs the digital message to a telematics gateway associated with the vehicle or a mobile device and then with a proxy remote.

The proxy remote, when located in the vehicle or within the communication range of the vehicle, converts the digital message to an RF signal which is then transmitted to the vehicle to operate systems in or associated with the vehicle.

In an alternative embodiment, the proxy remote is able to interact with a vehicle ignition immobilizer or passive entry system. The proxy remote receives RF commands from the vehicle, decodes the commands and transmits the commands to the remote control actuator system. The remote control actuator system receives a response from the key fob, decodes the response and transmits the data back to the proxy remote. The proxy remote can then retransmit the response via RF to the vehicle.

Alternative embodiments of this invention would include decoding the encryption algorithm of the vehicle's ignition immobilizer and keyless entry system and subsequently create a duplicate encryption system in the remote server, mobile device app or proxy remote which was still synchronized to the vehicle. To prevent causing a loss of synchronization of the original key fob with the vehicle through non-use, the remote control actuator could be requested to command a key fob button press every time the duplicate encryption system issued a command. This would ensure that if the vehicle owner decided to return to the original key fob again (to sell the vehicle for example), it would still be in synchronization with the vehicle.

Alternative embodiments of this invention could include methods to avoid transmission delays over cellular and internet connections by preloading several different button commands into memory on either the remote server, mobile device, telematics gateway or directly in the proxy remote. In this manner, the specific button command could be sent directly to either remote server or proxy remote for immediate transmission without having to wait for the remote control actuator system to be accessed. After a preloaded command was sent, it would be discarded and a fresh preloaded command requested from the remote control actuator to prepare for the next command.

The primary benefits of this invention is to enable IoT (internet of things) business models to control any vehicle's keyless entry and ignition systems and to secure the keyfob from any theft or tampering in the vehicle which would be possible when the remote control actuator was left in the vehicle. The secondary benefit of this invention is to eliminate the setup time required to place the remote control actuator in the vehicle. A third benefit is the relaxed environmental requirements for the remote control actuator design which wouldn't have to work outside an interior, ambient environment.

In accordance with another aspect of the present disclosure, equipment which can capture the encrypted, rolling code RF signal from a remote control whether emitted by manual or automated button pressing is contemplated. The equipment would include the ability to analyze the multiple transmissions of encrypted data either locally or remotely after transferring over the internet, to reverse engineer the public and private keys of the encryption algorithm. Further, equipment which can be located within or nearby the controlled RF devices (e.g. vehicles, garages, security systems) is contemplated which can receive and store the decrypted keys to enable the reproduction of encrypted, rolling code RF signals from the original remote control.

BRIEF DESCRIPTION OF THE SEVERAL VIEWS OF THE DRAWING

In the Figures, like reference numerals refer to like parts throughout the various views unless otherwise indicated. For reference numerals with letter character designations such as "102A" or "102B", the letter character designations may differentiate two like parts or elements present in the same Figure. Letter character designations for reference numerals may be omitted when it is intended that a reference numeral to encompass all parts having the same reference numeral in all Figures.

DETAILED DESCRIPTION

Aspects, features and advantages of several exemplary embodiments of the remote button actuation system will become better understood with regard to the following description in connection with the accompanying drawing(s). It should be apparent to those skilled in the art that the described embodiments of the present description provided herein are illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the present description as defined herein and equivalents thereto. Hence, use of absolute terms such as, for example, "will," "will not," "shall," "shall not," "must" and "must not" are not meant to limit the scope of the present description as the embodiments disclosed herein are merely exemplary.

The word "exemplary" is used herein to mean "serving as an example, instance, or illustration." Any aspect described herein as "exemplary" is not necessarily to be construed as exclusive, preferred or advantageous over other aspects.

In this description, the term "portable computing device" ("PCD") is used to describe any device operating on a limited capacity power supply, such as a battery. Although battery operated PCDs have been in use for decades, technological advances in rechargeable batteries coupled with the advent of third generation ("3G") wireless technology have enabled numerous PCDs with multiple capabilities. Therefore, a PCD may be a cellular telephone, a satellite telephone, a pager, a PDA, a smartphone, a navigation device, a smartbook or reader, a media player, a combination of the aforementioned devices, a laptop computer with a wireless connection, among others.

Figure 2:
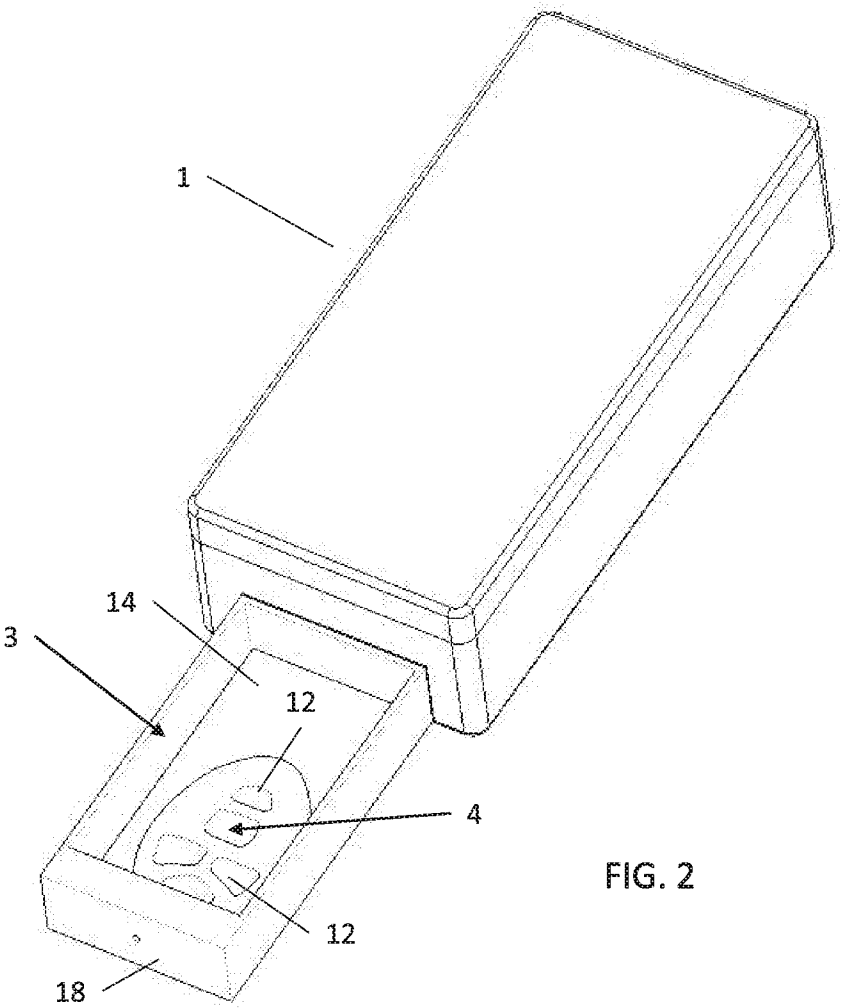
FIG. 2 is a top isometric view showing the key fob drawer extended from the drawer housing.
Figure 1:
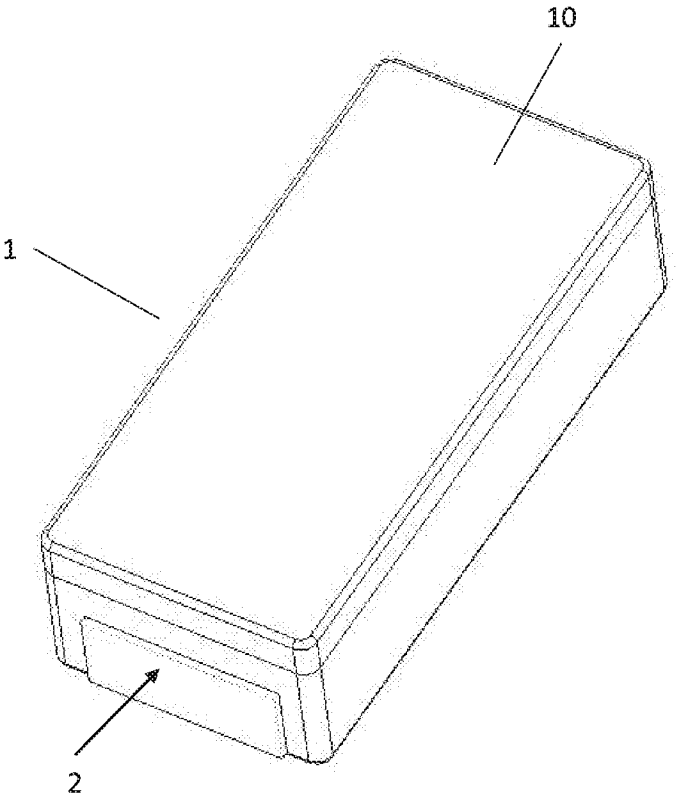
FIG. 1 is a top isometric view of an exemplary embodiment of the remote control button actuation system of the present disclosure.

FIG. 1 illustrates a remote control button actuation system 1 used to actuate a remote control constructed in accordance with the present disclosure. The actuation system 1 shown in FIG. 1 includes an outer housing 10 that is formed in two separate sections as will be described below. The outer housing 10 defines an open interior that receives a removable key fob drawer 3, which is shown in the retracted position in FIG. 1 and in the extended position in FIG. 2. The key fob drawer 3 is sized to receive a key fob 4 that includes a series of individual buttons 12 that can be separately depressed to send wireless command signals to a vehicle. As an example, the buttons 12 can be used to lock the car doors, unlock the car doors, start the engine, open the trunk, send a panic signal or perform other functions depending upon the configuration of the key fob 4. Although one specific configuration of a key fob 4 is shown in FIG. 2, it should be understood that various other configurations of the key fob 4 are contemplated as being within the scope of the present disclosure. In addition, the key fob 4 could be any type of remote that includes one or more buttons 12 that can be depressed to send a command signal to the vehicle when the remote is within the communication range of the vehicle. The communication range of the vehicle is typically all locations within the vehicle and a very close proximity to the vehicle.

The key fob 4 is shown positioned on a floor 14 of the drawer 3. It is contemplated that the floor 14 could include one or more sticky pads that allow the key fob 4 to be securely held in the position as shown in FIG. 2. The key fob drawer 3 includes a series of side walls 16 and a front wall 18. The front wall 18 can receive a removal cover 2 that forms part of an isolation enclosure as will be described.

Included within the open interior of the housing 10 is a three axis button actuator operable to move a plunger in the x, y and z axes such that the movable plunger can be accurately positioned above any one of the multiple buttons 12 on the key fob 4 when the key fob 4 is positioned within the key fob drawer. The actuator system includes a controller that is operable to control the position of the plunger and the movement in the z direction. One example embodiment of the three axis button actuator is shown and described in U.S. Pat. No. 9,576,414, the disclosure of which is incorporated herein by reference.

FIG. 2 illustrates the key fob drawer 3 is in the extended position. When the drawer 3 is in the extended position, the user can take a photo of the key fob 4 located within the drawer 3 utilizing a smartphone that is running application software. The application software on the smartphone processes the image to define the x and y positions of the center of each button 12 relative to the key fob drawer 3. The location of each button is determined based upon reference points of the drawer that are present in the photograph. The photograph of the key fob 4 within the drawer is taken with the drawer in the extended position. It is contemplated that the reference point in the drawer 3 could be reflective areas or markings on the floor 14 or the side walls 16 that allows the position of the key fob 4 to be accurately identified.

Once the location of the key fob 4 is identified within the drawer, this information is used to create location identification information which is sent from the application software on the smartphone to the controller located within the actuation system 1.

After the location of the key fob is identified utilizing the application software on the smartphone, the drawer 3 is retracted. The drawer 3 retracts to a known and physically defined location. Since the location of the key fob 4 is known relative to the floor 14 of the drawer 3 and the location of the drawer is also known, the controller can then operate the three-axis button actuator to position the plunger above any of the selected buttons 12 on the key fob 4.

The depth of the button press, which is the z button parameter, is determined using one or both of the following methods: 1) depressing the plunger while monitoring motor current and stopping at a predetermined amount of motor current and/or 2) monitoring for RF transmissions from the key fob indicating a button has been depressed.

The housing is designed to create part of a Faraday cage for blocking all RF signals into or out of the housing. The removable drawer cover 2 shown in FIG. 1 is also formed from a metallic material to define a portion of the Faraday cage when the key fob drawer 3 is in the retracted position shown in FIG. 1. An antenna is placed inside the Faraday cage for capturing RF transmissions of the key fob by the control system, which can then be relayed out of the housing.

Figure 4:
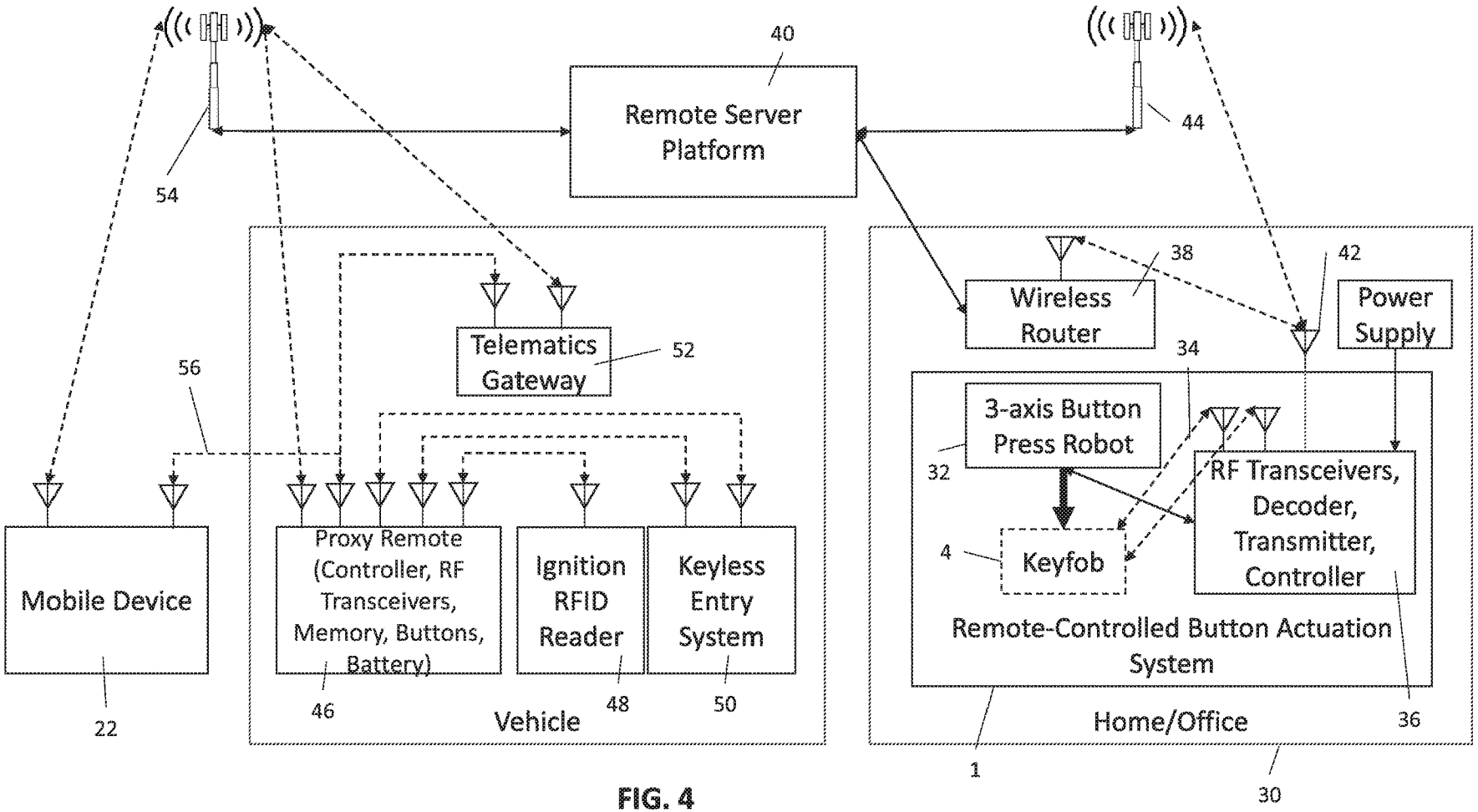
FIG. 4 is a mechanization diagram showing exemplary components of an exemplary embodiment of the remote button actuation system.

Referring now to FIG. 4, the remote control button actuation system 1 is designed such that the remote control button actuation system can be located in a secure location, such as a home or office 30. The entire remote control actuator system 1 can be securely located at the vehicle owner's home or business rather than being placed within the vehicle itself. In this manner, the key fob 4 can be completely separate from the vehicle to enhance security. As described previously, the remote control actuator system 1 includes the three-axis button pressing system 32 that can be programmed to press any one of multiple buttons 12 on the key fob 4. Although the three-axis button pressing system 32 is illustrated, it is contemplated that such system 32 could be replaced with a much simpler actuating system, such as if the system is used with a key fob having only one or two buttons. In either event, the system 32 is designed to activate/press a selected button on the key fob.

Once the key fob 4 is positioned within the drawer and the drawer is closed, the button pressing robot 32 can be actuated to move a plunger to cause the key fob 4 to generate the RF remote command signal that would otherwise be used to perform certain functions with respect to the vehicle. In the embodiment shown in FIG. 4, the wireless signals 34 generated by the key fob 4 are received within the control system 36. The control system 36 includes an RF transceiver, a decoder, a transmitter and a control unit for controlling activation of the systems within the remote control actuator system.

When the wireless RF signals are received from the key fob 4, the control system 36 decodes the wireless transmission and converts the RF transmission into a digital data message utilizing the decoder and controller. In this manner, the control system is able to convert an RF transmission into a digital message for further transmission. The digital message generated by the control system 36 can be transmitted away from the remote control button actuation system 1 utilizing multiple different types of communication. In the embodiment illustrated, a wireless router 38 can be used to communicate to a remote server platform 40 utilizing a WiFi communication protocol. Alternatively, a wireless antenna 42 can be utilized to communicate to a receiver 44, which in turn is in communication with the remote server platform 40. In this manner, the remote control actuator system can communicate utilizing long-range connectivity to the internet via cellular or Wi-Fi or can utilize Bluetooth or other wireless communication techniques to communicate to the remote server platform 40 through the receiver 44.

Figure 3:
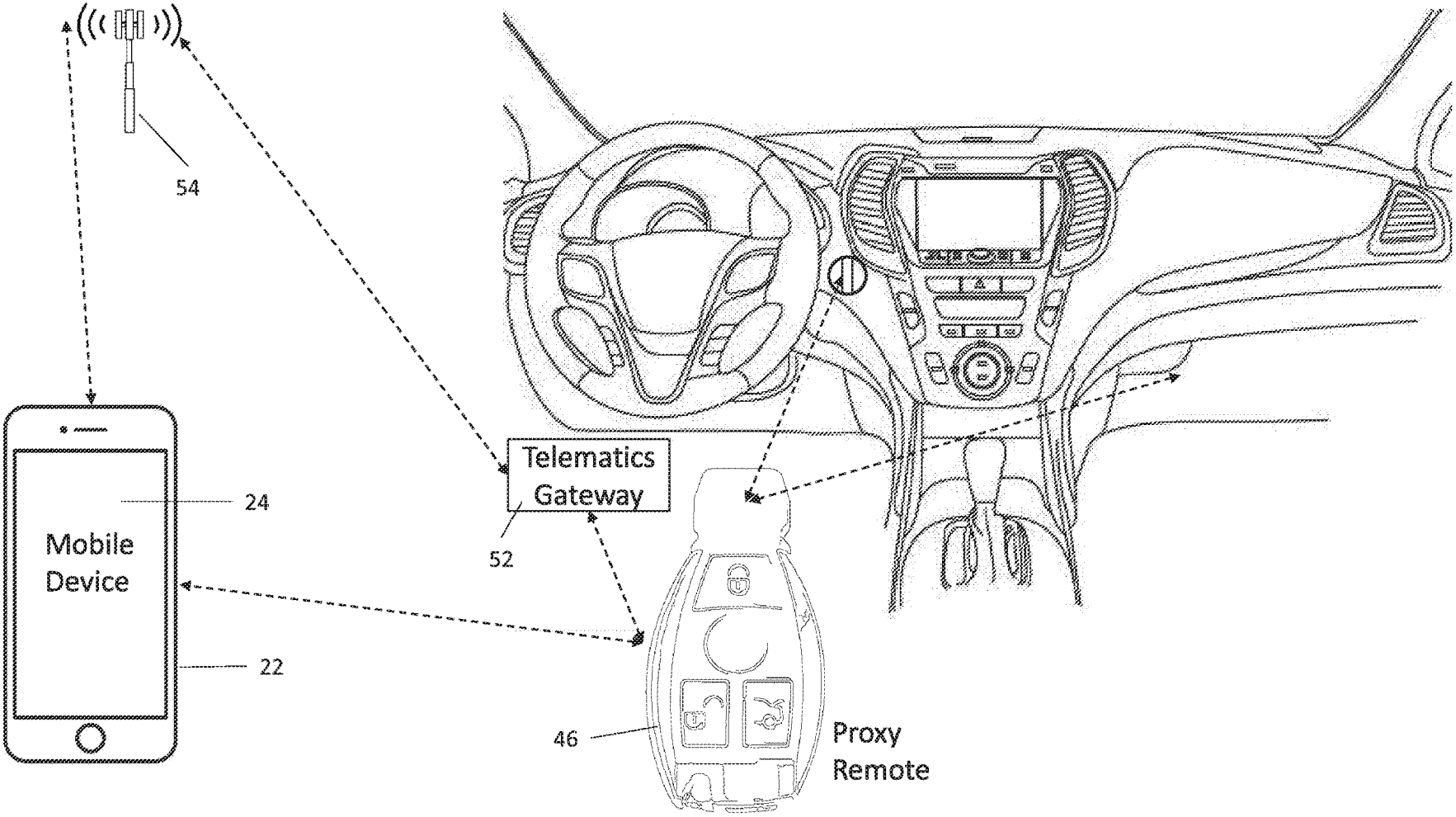
FIG. 3 is a schematic illustration of the proxy remote in the vehicle and illustrating the communication with various components of the system.

Referring now to FIGS. 3 and 4, the system of the present disclosure includes a proxy remote 46 that can be carried by the vehicle owner. The proxy remote 46 is a remote that is separate and distinct from the key fob remote 4 that is typically used with the vehicle. The proxy remote 46 can be positioned within or near the vicinity of the vehicle and is designed to interact with various systems in the vehicle when the proxy remote is within the communication range of the vehicle. As an illustrative example, the vehicle can include an RFID reader and/or low frequency passive entry/start. As illustrated in FIG. 4, the proxy remote 46 is able to communicate with the vehicle ignition RFID reader 48 and the keyless entry system 50. Further, the proxy remote 46 is able to communicate with a telematics gateway 52 and with a wireless receiver/repeater 54.

The proxy remote 46 is designed with the capability of decoding RF transmissions received from the vehicle and to encode RF transmissions that are transmitted to the vehicle. In this manner, the proxy remote 46 acts as a communication interface between a mobile device 22 of the user and the systems of the vehicle.

The mobile device 22 shown in FIG. 4 can be any type of user interface that allows a vehicle owner to enter desired commands relative to the vehicle. It is contemplated that the mobile device 22 will be a smartphone although other mobile devices are able to be used in accordance with the present disclosure. Many different types of visual interfaces can be displayed on the mobile device 22 that could replicate typical key fob button commands, such as locking/unlocking doors, opening a trunk. Through the use of the mobile device 22, the vehicle owner would be able to control operation of the vehicle.

The operation of the system of the present disclosure will now be described with reference to the drawing figures. Initially, when a vehicle owner wishes to carry out some commands related to operation of the vehicle, such as unlocking doors, opening the trunk, or starting the vehicle, the user engages a user interface 24 displayed on the screen of the mobile device 22. The mobile device 22 relays this desired command to the remote server platform 40 shown in FIG. 4. The remote server platform 40, in turn, relays the desired command to the control system 36 of the remote control button actuation system 1. A controller of the control system 36 would then issue control commands to the three-axis button pressing system 32 to press the corresponding button on the key fob 4, resulting in the generation of an RF remote command signal. The RF remote command signal generated by the key fob 4 is received by the control system 36 and converted into digital form and stored in memory. The digital form of the RF remote command message is then transmitted away from the button actuation system 1, either utilizing the wireless router 38 or the antenna 42, to the remote server platform 40. From the remote server platform 40, the digital version of the button command is relayed either to the telematics gateway 52, to the mobile device 22 or directly to the proxy remote 46. The telematics gateway 52 is in communication with the proxy remote 46 such that the digital message from the controller of the remote control actuator system 1 is received by the proxy remote 46. As indicated, the digital message from the controller corresponds to the RF remote command signal generated by the key fob 4 for the vehicle.

The proxy remote 46 is designed to convert the digital message to an RF vehicle command signal which can then be transmitted by the proxy remote 46 and received by the ignition RFID reader 48 or the keyless entry system 50 of the vehicle. The RF vehicle command signal transmitted by the proxy remote 46 corresponds to the RF remote command signal generated by the key fob 4 such that the proxy remote 46 acts like the key fob 4. In this manner, a command received from a user at the mobile device 22, such as unlock the doors, ultimately results in the generation of an RF vehicle command signal by the proxy remote 46 to control the desired operation of various vehicle systems, such as the ignition, vehicle locks or trunk within the vehicle. In such an embodiment, the key fob 4 remains securely located at a home or office of the vehicle owner and is not present within the vehicle or located within communication range of the vehicle. The proxy remote 46 is able to generate the RF commands only upon receipt of digital messages from the remote control button actuation system 1. Thus, the proxy remote 46 can only function in combination with the key fob 4. Such enhanced security is believed to be a desirable feature and component of the system of the present disclosure.

As described above, several transmissions of information must occur when a vehicle owner selects a function on the mobile device 22. In a best case scenario, the messages are transmitted without any significant delays. However, in order to avoid transmission delays over the cellular and internet connections, several different button commands messages can be preloaded into the memory on either the remote server platform 40 or directly onto the proxy remote 46. As an example, the controller of the control system 36 can actuate the door unlock button on the key fob 4 multiple times and create a digital message for the RF remote command signal generated during each button actuation. The digital messages could then be stored in the remote server platform 40 or stored directly on memory included within the proxy remote 46. The pre-stored command messages would then be accessed immediately after the interface screen on the mobile device 22 is depressed.

If the mobile device 22 were in direct communication with the proxy remote 46, such as shown by the communication line 56, depression of a portion of the screen of the mobile device 22 would immediately result in the proxy remote generating the RF vehicle command signals to the system within the vehicle. Once a pre-loaded command was utilized, the command would be removed from memory and a fresh pre-loaded command would be requested from the remote control actuator system 1. In this manner, a stored queue of commands would be available either within the remote server platform 40 or the memory on the proxy remote 46.

In yet another alternate embodiment of the present disclosure, the proxy remote 46 would be configured to enable the proxy remote 46 to interact with a vehicle ignition immobilizer or passive entry system by receiving RF commands from the vehicle. The RF commands from the vehicle would be decoded within the proxy remote 46, transmitted to the remote control button actuation system 1 and finally retransmitted via RF to the key fob 4. The key fob 4 would then respond with an RF response, which would be decoded within the remote control button actuation system 1 and transmitted back to the proxy remote, which would then transmit the response via RF to the vehicle. Such configuration would allow the proxy remote 46 to communicate the required response to the vehicle even though the key fob 4 for the vehicle is located at a remote location.

In yet another alternate embodiment of the present disclosure, the encryption algorithm used by the vehicle ignition immobilizer and keyless entry system could be decoded by studying the RF commands and responses from the vehicle and key fob 4. In such an embodiment, a duplicate encryption system would be created in the remote server platform 40, a mobile device app or proxy remote 46 that was synchronized to the vehicle. To prevent a loss of synchronization of the original key fob with a vehicle through non-use, a remote control button actuation system 1 could be requested to command a key fob button press every time the duplicate encryption system issues a command. This would ensure that if the vehicle owner decided to return the original key fob, it would be in synchronization with the vehicle.

In accordance with another contemplated feature of the present disclosure, the remote server platform 40 or other processing locations can be used to reverse engineer the public and private keys of the encryption algorithm utilized by the vehicle and key fob 4. As an illustrative example, when the key fob 4 and vehicle use an encrypted, rolling code RF signal from the key fob 4, the transmissions can be analyzed in an attempt to determine the encryption algorithm. Once the encryption algorithm has been determined, direct communication with the key fob 4 will no longer be required since the RF signal generated by the key fob 4 can be replicated either at the remote server platform 40 or at the proxy remote 46.

In the embodiment described immediately above, the rolling code RF signals can be used to control a variety of controlled RF devices, such as vehicles, garage door openers, and security systems. The use of such systems would eliminate the need of a physical remote control device such that the devices could become part of an internet of things (IoT) business model.

As previously described, the three-axis button press robot 32 is included as part of the remote control button actuation system 1. However, it is contemplated that the three-axis button press robot 32 could be replaced with a much more simple design that includes an actuator that is movable along a single-axis. In such an embodiment, one or more plungers would be manually located above a button on the key fob 4. The manual location of the plungers would thus require the plungers to move only in the z direction since the plunger would be accurately positioned above the key fob button 12. In such an embodiment, the controller 36 shown in FIG. 4 would still control the actuation of the plunger causing the key fob 4 to generate the RF signal. Such an embodiment may drastically decrease the cost of the remote control actuator system 1 since the button pressing robot 32 would be drastically simplified and manually set up by the user.

The invention claimed is:

1. A system to actuate one or more functions associated with one or more buttons on a remote for a vehicle based on command signals generated by a mobile device, the system comprising:

a housing configured to securely receive the remote;

a user interface included on the mobile device;

a controller located within the housing and configured to receive the command signals from the mobile device;

a button actuator being configured to engage one of the buttons of the remote such that the remote generates an RF remote command signal, wherein the controller converts the RF remote command signal into a digital message;

a transmitter operable to transmit the digital message;

a proxy remote positionable within a communication range of the vehicle to receive the digital message and to convert the digital message into a RF vehicle command signal.

2. The system of claim 1 wherein the proxy remote is operable to transmit the RF vehicle command signal.

3. The system of claim 1 further comprising a remote server platform positioned to receive the digital message from the controller and to relay the digital message to the proxy remote.

4. The system of claim 3 wherein the remote server platform receives the command signals from the mobile device.

5. The system of claim 3 further comprising a telematics gateway positioned to communicate with the proxy remote and the remote server platform.

6. The system of claim 1 wherein the proxy remote is operable to receive an RF identification signal from the vehicle and to transmit a response RF identification signal to the vehicle.

7. The system of claim 1 further comprising a memory device operable to store a plurality of digital messages from the controller.

8. The system of claim 1 wherein the button actuator is positioned within the housing.

9. The system of claim 1 wherein the housing is located outside of the communication range of the vehicle.

10. The system of claim 1 wherein the remote is a key fob.

11. An actuation system to actuate one or more buttons on a remote for a vehicle based on command signal generated by a mobile device, the actuation system comprising:

a housing configured to securely receive the remote, wherein the housing is located outside of a communication range of the vehicle;

a user interface included on the mobile device;

a controller located within the housing and configured to receive the command signals from the mobile device and convert the command signal into position commands;

a button actuator being configured to receive the position commands from the controller and actuate one of the buttons of the remote such that the remote generates an RF remote command signal, wherein the controller converts the RF remote command signal into a digital message;

a transmitter operable to transmit the digital message;

a proxy remote positionable within the communication range of the vehicle to receive the digital message and to convert the digital message into a RF vehicle command signal.

12. The system of claim 11 wherein the proxy remote is operable to transmit the RF vehicle command signal.

13. The system of claim 11 further comprising a remote server platform positioned to receive the digital message from the controller and to relay the digital message to the proxy remote.

14. The system of claim 13 wherein the remote server platform receives the command signal from the mobile device.

15. The system of claim 13 further comprising a telematics gateway positioned to communicate with the proxy remote and the remote server platform.

16. The system of claim 11 wherein the proxy remote is operable to receive an RF identification signal from the vehicle and to transmit a response RF identification signal to the vehicle.

17. The system of claim 11 further comprising a memory device operable to store a plurality of digital messages from the controller.

18. A method of initiating one or more functions of a vehicle that are each associated with one or more buttons on a remote for the vehicle utilizing a mobile device, the method comprising:

positioning the remote in a housing that is located outside of a communication range of the vehicle;

generating a command signal from the mobile device;

receiving the command signal with a controller located within the housing;

engaging one of the buttons on the remote associated with the command signal such that the remote generates an RF remote command signal;

converting the RF remote command signal into a digital message;

transmitting the digital message from the housing;

receiving the digital message at a proxy remote positioned within the communication range of the vehicle;

converting the digital message into a RF vehicle command signal at the proxy remote; and transmitting the RF vehicle command signal from the proxy remote.

19. The method of claim 18 further comprising the step of receiving the digital message in a remote server platform and relaying the digital message from the remote server platform to the proxy remote.

20. The method of claim 18 further comprising the steps of:

receiving an RF identification signal from the vehicle at the proxy remote; and transmitting a response RF identification signal to the vehicle from the proxy remote.

* * * * *